United States Patent [19]

Ampulski

[11] Patent Number: 4,734,162

[45] Date of Patent: Mar. 29, 1988

[54] HARDWOOD PULP HAVING A TACTILE SENSE OF SOFTNESS, AND TISSUE PAPER WEBS THEREOF

[75] Inventor: Robert S. Ampulski, Fairfield, Ohio

[73] Assignee: The Procter & Gamble Company, Cincinnati, Ohio

[21] Appl. No.: 904,529

[22] Filed: Sep. 5, 1986

Related U.S. Application Data

[60] Division of Ser. No. 766,063, Aug. 14, 1985, Pat. No. 4,634,499, which is a continuation-in-part of Ser. No. 490,926, May 2, 1983, abandoned.

[51] Int. Cl.[4] ..... C13K 1/02; C13K 13/00; D21C 3/06

[52] U.S. Cl. ..... 162/84; 127/37; 162/86

[58] Field of Search ..... 162/83, 84, 16, 113, 162/117, 63, 14, 9, 100; 127/37; 530/500

[56] References Cited

U.S. PATENT DOCUMENTS

| | | | |
|---|---|---|---|
| 1,830,421 | 11/1931 | Bradley | 162/84 |
| 2,640,774 | 6/1953 | Russ et al. | 162/83 |
| 3,994,771 | 11/1976 | Morgan et al. | 162/113 |
| 4,120,747 | 10/1978 | Sarge et al. | 162/117 |
| 4,259,147 | 3/1981 | Gordy | 162/16 |

OTHER PUBLICATIONS

Bulko; Abstract ABIPC, vol. 45, No. 6, Dec., 1974, #5925(u), p. 606.

Parfinova; Abstract ABIPC, vol. 41, No. 6, Dec. 1970, #5374, p. 522.

*Primary Examiner*—Steve Alvo

*Attorney, Agent, or Firm*—Monte D. Witte; Thomas J. Slone; Fredrick H. Braun

[57] ABSTRACT

Pulps having a tactile sense of softness which are made from hardwoods and processes for making such pulps. The process comprises the steps of: providing hardwood chips having specified sizes; introducing the chips into a digester; removing substantially all the free oxygen from the chips within the digester; providing a cooking liquor comprising from about 0.4% to about 3% ammonia and from about 9% to about 14% sulphur dioxide; completely submerging in cooking liquor all the chips within the digester; sulfonating the lignin within the chips at a temperature of less than about 110° C.; rapidly increasing the temperature to an appropriate hydrolysis temperature; hydrolyzing the lignin sulfonation products at a temperature of from about 140° to about 155° C. at a pH from about 2 to about 3; and rapidly reducing the temperature of the system following the hydrolysis. Pulps made by this process were made into useful tissue paper webs having enhanced softness properties.

18 Claims, No Drawings

HARDWOOD PULP HAVING A TACTILE SENSE OF SOFTNESS, AND TISSUE PAPER WEBS THEREOF

CROSS-REFERENCES TO PRIOR APPLICATIONS

This is a divisional of Application Ser. No. 766,063 filed Aug. 14, 1985 (now U.S. Pat. No. 4,634,499) which is a continuation-in-part of Application Serial No. 490,926, filed May 2, 1983 (now abandoned).

BACKGROUND OF THE INVENTION

1. Field of the Invention

This invention concerns wood pulp made from hardwoods by the sulfite process and paper made from the pulp. More particularly, this invention concerns a specially prepared wood pulp which has unusual softness properties and the soft tissue paper webs made from the pulp.

2. Background Art

The sulfite pulping or digestion process and, more particularly, the acid sulfite pulping process which is sometimes referred to as the acid bisulfite process are well known and extensively practiced throughout the paper industry. Excellent discussions of the acid bisulfite pulping process, as well as of the operations and equipment used in conjunction with it, are found at numerous places in the literature. Three commonly cited references are: (a) McDonald, Ed. *Pulp and Paper Manufacture: Volume* 1: *The Pulping of Wood* (Second Edition), McGraw-Hill (New York, 1969); (b) Casey, *Pulp and Paper Chemistry and Chemical Technology: Volume* 1: *Pulping and Bleaching,* (Second Edition), Interscience publishers (New York, 1960); and (c) Rydholm, *Pulping Processes,* Interscience Publishers (New York, 1965).

Acid bisulfite processes are also disclosed in the patent literature such as U.S. Pat. No. 4,295,929 which issued to Leithen on Oct. 20, 1981.

All of the references listed above, which are incorporated herein by reference, and others of their ilk, provide the background and the framework for the present invention. The teachings of these references pertaining to process operations, equipment, process conditions, and the like can be used in conjunction with the present invention *except* insofar as the present invention requires modification of the teachings in unique and unobvious ways to produce the unexpected results obtained by the practice of the present invention.

Morgan and Rich in U.S. Pat. No. 3,994,771, issued Nov. 30, 1976, incorporated herein by reference, teach and claim a process for forming a wet-laid composite, soft, bulky, and absorbent paper web comprising at least two layers prepared from at least two furnishes preferably comprising different fiber types. This process has been used to make an exemplary, commercially successful sanitary tissue comprising three layers. The center layer comprises primarily northern softwood kraft pulp fibers while the two outer layers are each formed from a furnish comprising a mixture of shorter fibers, normally about 40% northern hardwood sulfite fibers and about 60% eucalyptus fibers. The presence of the shorter fibers in the two outer layers markedly increases the tactile feeling of softness of the sanitary tissue product. More especially, the softness is markedly enhanced by the use of eucalyptus fibers in combination with common sulfite hardwood fibers in the outer layers.

While the product, constituted as described, is quite acceptable to consumers, eucalyptus fibers are more expensive than other more common fibers such as sulfite hardwood fibers and are sometimes subject to vagaries of supply. Replacement of the eucalyptus fibers with other less expensive and more readily available fibers is and has been a sought after goal, but one which is reasonable and acceptable only when the resulting eucalyptus-free product maintains the physical characteristics of the eucalyptus-containing product.

SUMMARY OF THE INVENTION

This invention is of a specific acid bisulfite pulping process for making soft wood pulp fibers. It has been discovered that within the framework of the conventional acid bisulfite process, controlling specific parameters within specific limits will result in hardwood pulp fibers having unique and unexpected softness properties. The process variables requiring control include:

A. Chip size within the range of from about 0.6 to about 2.5cm;

B. Oxygen removal from the digester, preferably by steaming prior to introduction of pulping chemicals;

C. Chemical selection (i.e., the use of an ammonium base) for the cooking liquor;

D. Complete initial submersion of chips in cooking liquor within the digester;

E. Lignin sulfonation temperature of less than about 110° C.;

F. Rapid temperature increase (i.e. about 0.75° to 3° per minute) to hydrolysis temperature;

G. pH control during hydrolysis in the range of from about 2 to about 3; and

H. Rapid cool-down of the pulp mass following digestion.

Accordingly, it is an object of the present invention to provide soft hardwood pulp useful in making soft paper webs.

A further object of this invention is to provide a process for making soft hardwood pulp.

A still further object of this invention is to provide for the replacement of eucalyptus pulp by soft hardwood pulp.

DETAILED DESCRIPTION OF THE INVENTION

While this specification concludes with claims particularly pointing and distinctly claiming the subject matter regarded as the invention, it is believed that the invention can be more readily understood through perusal of the following detailed description of the invention and of the appended examples.

As used in conjunction with paper, the term "soft" describes a pleasing tactile sensation perceived when the human body is contacted with the paper web, when the paper web is crumpled within the hand, etc. Attempts are sometimes made to measure softness objectively through the use of various instruments. More commonly, softness is measured by the use of human sensory evaluation panels.

While the acid bisulfite pulping process has been known and used commercially for some period of time, it has been surprisingly discovered that soft pulp can be made by this process provided specific process parameters are controlled within specified limits. In brief outline, the process of this invention comprises the steps of:

1. Providing hardwood chips having specified sizes;

2. Introducing the chips into a digester;
3. Removing substantially all the free air and, consequently, the free oxygen from the chips within the digester;
4. Providing a cooking liquor having a specified chemical composition;
5. Introducing the cooking liquor into the digester in such quantity as to completely submerge the chips within the digester;
6. Sulfonating the lignin within the chips to a commercially reasonable extent by rapidly increasing the temperature within the digester to a convenient lignin sulfonation temperature not exceeding about 110° C. and maintaining it at that level for an appropriate time;
7. Increasing rapidly the temperature of the system within the digester to an appropriate hydrolysis temperature;
8. Maintaining the temperature of the system at the appropriate hydrolysis temperature while maintaining the pH of the system within the range of from about 2 to about 3 to substantially hydrolyze the lignin sulfonate formed during the lignin sulfonation step; and
9. Decreasing rapidly the temperature of the system following the hydrolysis.

In the outline of the process of this invention, the first step was listed to be the provision of wood chips. While this is properly the first step of the process of this invention, those skilled in the art recognize that, in a philosophical sense, the first operation of any pulping process is the selection of the species of wood to be treated by the process. This invention contemplates the use of angiosperms or deciduous trees, commonly called hardwoods. Aspen and cottonwood (Populus, species), beech (Fagus species), birch (Betula species), mapel (Acer species), poplar (Liriodendrum species), Cherry (Prunus species) and oak (Quercus species) are examples of woods useful herein. Preferably, aspen or mixtures of hardwoods are used in the process of this invention.

Essentially all chemical pulping processes use wood chips. This process is no exception. Thus, the first step in the process of this invention is the provision of hardwood chips.

Pulping, or the liberation of essentially individual and intact cellulose fibers found in wood, can be described by a simplistic two-stage model. In the first stage, lignin (the complex, insoluble, naturally occurring organic cement which binds the fibers together in the native wood) is reacted with chemicals (the cooking liquor) to form lignin derivatives (in the case of the acid bisulfite process, lignin sulfonates). In the second stage these lignin derivatives are hydrolyzed (generally in the presence of a catalyst) to form soluble lignin degradation products which are dissolved from the wood mass thereby freeing the individual fibers. The first stage of the pulping operation cannot begin until the cooking liquor is brought into contact with the lignin existing between the fibers in the wood chips. The rate at which the contact occurs, and the extent of the contact, is dependent upon many factors. Among these are wood species, previous history of the chips, moisture level in the chips, rate of diffusion of the cooking liquor within the chips, and length of the diffusion path., It has been discovered that the length of the diffusion path is the most important of the rate-controlling variables.

If the chip is too large, diffusion of the cooking liquor to the interior of the chip requires too long a time for practical operation.

Lignin sulfonation and hydrolysis are the desired reactions during the pulping process, but undesirable side reactions between the cooking liquor and the cellulose of the fibers occur simultaneously. Pulping processes, then, must create and maintain a balance between the formation of lignin derivatives (sulfonates) and their solubilization on the one hand and the degradation of the cellulose on the other. While the cooking liquor, during the diffusion or impregnation stage of pulping process, is generally considered to merely be contacting lignin, chemical reactions between the lignin and the cooking liquor and between the cellulose and the cooking liquor are actually occurring. Extended diffusion or impregnation times required by large chips result in extended periods of contact between the cooking liquor and the cellulose fibers on the surface of the chips and thereby result in increased degradation of the cellulose near the surface of the chip.

It has been surprisingly discovered that, for most hardwood species, a maximum chip size (or, more properly, dimension) of about 2.5 centimeters (cm) is required if one is to produce soft pulp from the hardwood chips with a reasonable reaction time.

It can be readily appreciated that if the extended diffusion times caused by large chips result in undesirable degradation of the cellulose at the surface of the large chips, small chips will, at the same time, undergo undesirable cellulose degradation throughout because the small chips are completely impregnated before larger chips, thereby allowing an extended period of time for reaction between the cooking liquor and the cellulose not only at the surface of the chip, but throughout the chip. It has been surprisingly discovered that the hardwood chip should have a minimum size (or dimension) of about 0.6 cm.

After the chips are formed from the hardwood trees by any convenient means well known to those skilled in the art, the chips are segregated by size, also by any convenient means known to those skilled in the art. Chips falling outside the maximum size range mentioned above are recycled through the chipping process to have their size further reduced. Chips smaller than the minimum size recited above are separated from the pulping process and are used at other places within the pulp mill as for fuel in the mill boilers.

Thus, the first step in the process of this invention comprises providing hardwood chips having dimensions falling within the range of from about 0.6 to about 2.5 cm.

The second step in the process of this invention comprises introducing the wood chips into a digester. The chips are conveyed by any convenient means from the chipper and size classification apparatus to the digester and introduced thereinto. The digester can be any convenient equipment well known to those skilled in the art. Typically, the digester is a large vessel having inlet and outlet ports as well as auxiliary piping, pumps, heat exchangers and the like associated with it. The actual design of the digester is immaterial so long as it can be used to accomplish the process of this invention.

The third step in the process of this invention comprises removing from the system contained within the digester the oxygen associated with the chips. Oxygen enters the digester with the air which has diffused into the chips and which has been trapped in pockets around and about the chips.

As will be discussed more fully hereinafter, in forming the cooking liquor used in the process, sulfur dioxide is reacted with water to form sulfurous acid which then dissociates to form the bisulfite ion which plays a major role in the production of lignin derivatives. Oxygen present in the system can react with excess sulfur dioxide to form sulfur trioxide which, in turn, will react with water to form sulfuric acid. Sulfuric acid attacks cellulose in the fiber causing degradation which is manifested by poor fiber color and loss of softness properties.

Any convenient means can be used to remove the oxygen from the digester. Evacuation of the air from the system can be used, but such a technique is not preferred.

The preferred method of removing oxygen is by displacement of the air with steam. In fact, this means of removing oxygen from the system is so preferred that the third step of the process is sometimes referred to as the presteaming step. Not only does the introduction of steam into the digester remove oxygen from the system by displacement, but two auxilliary benefits accrue: the moisture content of the chips is increased to favorable levels and the temperature of the chips is raised thereby resulting in more rapid diffusion of cooking liquor within the chips and more rapid lignin reaction.

The fourth step in the process of this invention comprises providing cooking liquor.

Fresh liquor is prepared by first either dissolving ammonia ($NH_3$) in water or by diluting aqueous ammonium hydroxide. Sulfur dioxide ($SO_2$, liquid or gaseous) is then added to the ammonium solution. Fresh liquor comprises from about 0.4% to about 3% ammonia and from about 9% to about 14% sulfur dioxide. (All percentages used in this specification are weight percentages.) Liquor actually charged to the digester preferably comprises from about 40% to about 60% fresh liquor, from about 30% to about 50% side relief liquor (as hereinafter described) and up to about 20% fresh water.

The fifth step in the process of this invention comprises impregnating the deoxygenated chips with the cooking liquor. Impregnation is accomplished by introducing the cooking liquor into the digester in such an amount that all of the chips within the digester are completely covered with (or submerged in) liquor. Any convenient means by which the digester can be supplied with cooking liquor is satisfactory. As will be discussed hereinafter, a subsequent step in the process of tis invention is the sulfonation of the lignin in the chips by maintaining the chips in contact with the cooking liquor at a temperature of less than 110° C. for a period of about 30 minutes. It is advantageous that the chips and the cooking liquor reach the sulfonation temperature as rapidly as possible. Consequently, it is preferred that the chips in the digester be at an elevated temperature because of the steaming of the chips to remove oxygen and that the cooking liquor be introduced at a temperature sufficient to bring the mass to the temperature selected for sulfonation.

Typically, impregnation is accomplished in from about 25 to about 35 minutes.

The sixth step in the process of this invention comprises reacting the lignin and the cooking liquor at a temperature not greater than about 110° C. For convenience, this step is referred to as the sulfonation step. During this stage of the pulping operation the cooking liquor reacts with the lignin within the wood chips to form lignin derivatives which can later be hydrolyzed into soluble degradation products. Lignin is a complex organic material and its reaction with the cooking liquor is a complex organic reaction which results in many different products. It is generally believed that the primary reaction is a sulfonation reaction and that the bulk of the lignin derivatives are lignin sulfonates. However, other reactions are occurring and other lignin derivatives are being formed during this step.

It has been surprisingly discovered that a key element in the production of soft hardwood pulp is the sulfonation of the lignin at a temperature not exceeding about 110° C. The time required for the requisite reaction is, naturally, a function of temperature. It has been determined that at a temperature of about 110° C., chips of the size used in this invention which have been completely impregnated with cooking liquor in the absence of oxygen undergo sufficient lignin sulfonation in about 30 minutes. Those skilled in the art can readily determine other time and temperature combinations which will result in the desired product. The temperature of the system is preferably maintained at the desired level and the liquid in the system is properly agitated by recycling liquor through heat exchangers outside the digester.

Impregnation and sulfonation are considered to be two steps in this discussion. Those skilled in the art will readily recognize that sulfonation will occur during impregnation. Separation of the process into two distinct steps at this point is done for convenience.

The seventh and eighth steps in the process of this invention comprise, respectively, increasing the temperature of the mass of chips within the digester to the hydrolysis temperature and hydrolyzing the sulfonated lignin at that elevated temperature at a pH within the range of from about 2 to about 3. These two steps will be discussed together.

During the sulfonation step, lignin sulfonates (and other derivatives) are formed. These derivatives can be hydrolyzed in the presence of acid to form lignin degradation products which are soluble. The soluble lignin degradation products are, in a later process step, washed from the system thereby freeing the wood from the adhesive which had bound the cellulose fibers together.

As with all reactions with naturally occurring complex organic materials, numerous chemical reactions occur simultaneously. During the hydrolysis of lignin sulfonates, the cellulose and the hemicellulose comprising the fiberous portion of the wood are also being reacted (hydrolyzed) by the acid cooking liquor. Using the same type of simplistic view used before, a view which will not totally and inclusively correct is, nonetheless, quite practical and generally accepted within the art, one can consider the hydrolysis stage of the pulping process to comprise three chemical reactions: hydrolysis of lignin sulfonate; hydrolysis of hemicellulose; and hydrolysis of cellulose. Obviously, hydrolysis of lignin sulfonate is the preferred reaction since this converts insoluble lignin derivatives to soluble degradation products. Hydrolysis of the cellulose fibers is normally considered to be an undesirable side reaction because such hydrolysis damages and destroys the very product the pulping process is designed to produce. Likewise, hydrolysis of hemicellulose associated with the fibers has also in the past been considered to be an undesirable side reaction since conversion of hemicellulose into soluble degradation of products results in reduced product yield. As will be discussed hereinafter, degradation of hemicellulose to a limited extent is actually desirable in the production of soft hardwood pulp.

The rates of the three hydrolysis reactions are each dependent upon a number of complex factors including, among others, pH, temperature, nature of reactants, concentration of reactants, extent of previous reaction (sulfonation), etc. It has been surprisingly discovered that a proper balance between the three competing reactions can be maintained by carefully controlling the temperature and the pH of the reaction system provided, naturally, that the prior sulfonation of the lignin has been performed in an adequate and appropriate manner as taught hereinbefore.

Further, it has been discovered that the proper balance between hydrolysis of lignin sulfonate and hemicellulose and cellulose is obtained if the temperature of the system is raised at a rapid rate from the sulfonation temperature to the hydrolysis temperature.

Thus, the seventh step in the process of this invention comprises increasing the temperature of the system in the digester from the sulfonation temperature to the hydrolysis temperature at a rate of from about 0.75° to about 3° C. per minute.

The eighth step in the process of this invention comprises hydrolyzing the lignin sulfonate (and the hemicellulose) at a temperature of from about 140° to about 155° C. at a pH of from about 2 to about 3 over a period of from about 30 to about 80 minutes. The actual time of hydrolysis will depend upon a number of factors such as the nature of the wood, the nature of the sulfonation, and the nature of the products desired.

Temperature increase and maintenance can be effected either by increasing the temperature of the cooking liquor recirculating about the digester or by adding heat directly to the digester. The pH of the cooking liquor can be measured and controlled by any conventional means.

It is during the seventh and eighth steps of the process of the invention that an optional operation termed "side relief" is preferably employed. Once the chips have been completely impregnated with cooking liquor as by completely submerging them for the noted period of time and once the sulfonation is completed, it is no longer necessary that the liquid level in the digester be maintained so as to completely cover the chips. Economies of operation are realized if at least a substantial portion of the free cooking liquor within the digester (i.e., that fraction of the cooking liquor which is not impregnated into the chips) is removed from the system comprising the digester. In the first place, this free cooking liquor is at least partially unreacted and is useful in subsequent pulping operations. If it were to remain in the digester during the hydrolysis reaction, the excess liquor would become contaminated with reaction products. Further, the temperature in the digester must be maintained at an elevated level; removal of excess liquor from the digester materially reduces the energy required to maintain the appropriate temperature. Thus, a substantial proportion of the free cooking liquor is removed from the system comprising the digester.

That portion of the free cooking liquor remaining in the digester system is recirculated through the bed of chips in the digester. The exact means of this recirculation depends on the geometry of the digester. In a preferred geometry, free liquor is removed from an outlet port located near the physical center of the digester. The removed liquor is then separated into two streams, the first of which is returned to the top of the digester so that it may percolate through the bed of chips in the upper section of the digester while the second is introduced into the bottom of the digester so that it may flow upward around and about the chips in the lower section of the digester. Preferably, the recycling stream of cooking liquor is heated by any convenient method as a means for maintaining the hydrolysis temperature within the digester.

The ninth step in the process of this invention comprises rapidly terminating the hydrolysis at the appropriate point. This rapid termination is accomplished by quickly cooling the system as by rapidly reducing the pressure of the system in less than about 20 minutes and by removing (blowing) the pulp from the digester over a period of time not exceeding about 30 minutes.

The hydrolyzed wood pulp issuing from the digester is then treated as in any conventional pulping process. That is to say, the pulp is washed to remove the lignin and hemicellulose degradation products and other impurities. The wash stream is treated to recover chemicals present therein and to make best use of the fuel value of the degradation products.

When one follows the process of this invention as outlined hereinbefore, one obtains hardwood fibers which can be used to make exceptionally soft webs of paper and which can be used to replace eucalyptus fibers in soft tissue paper webs.

As with any process involving the use of natural materials, certain variables associated with this invention cannot be fully specified because of the wide variability of the feed stock. That is to say, it is anticipated that this process will be used to process a wide variety of hardwoods. The exact specification of the conditions and parameters within those ranges noted in this detailed description of the invention is impossible because of the wide variability of the woods going into the system. (Even if the process were, for example, limited to production of hardwood pulp from a single species of wood, such as quaking aspen (*Populus tremuloids*), it would still be impossible to specify the exact value of the parameters to be used because of the inherent variability within the single species caused by variations of growing conditions, soil conditions, genetic character, storage conditions, etc.). Therefore, with any given feed stock (i.e., pulp mill run of wood), it will be necessary to do a minor amount of experimentation to determine the precise value of the parameters within the ranges noted to produce the desired soft hardwood pulp. This experimentation can be advantageously conducted by routinely processing batches of pulp, examining the output from a given batch, and adjusting the parameters of succeeding batches based upon the findings.

The evaluation can be conveniently done by taking the samples of the completed pulp, forming the pulp into paper webs of the type desired, evaluating the webs by either objective mechanical means or by the use of human sensory evaluation panels.

In a preferred mode of operation, the extent of hydrolysis of the system can be controlled by an examination of the degradation products of hydrolyzed hemicellulose.

Cellulose, the primary constituent of the fibers issuing from this process, is a high molecular weight polymer having repeating glucose units. Cellulose comprises glucan units and is fully hydrolyzed to glucose. On the other hand, hemicellulose is a lower molecular weight polymer (polysaccharide) containing various amounts of mannan, xylan, galactan, and arabinan. Mannan and xylan are hemicellulose units which are completely hydrolyzed to, respectively, mannose and xylose.

The quantity of xylan and glucan and the ratio of xylan to mannan in fibers change as the relative extent of hydrolysis of the cellulose and the hemicellulose change with changing reaction conditions. The quantity of xylan and glucan and the xylan to mannan ratio are indicative of the softness of the pulp. Thus, the extent of hydrolysis can be determined by examining the xylan and glucan contents and xylan to mannan ratio of the fiber and using this information to control the extent of hydrolysis, either of a given batch or of succeeding batches. Preferably, glucan should be present at from about 80% to about 92%, xylan should be present at from about 6% to about 8%, and the ratio of xylan to mannan in the soft pulp of this invention should be from about 2.5 to about 3.7. Pulps having glucan and xylan contents and xylan to mannan ratios within the stated ranged have been found to have a superior sense of tactile softness. It is especially preferred that the xylan content be between 7.0% and 8.0%, within which range softness of the hardwood pulp approaches the softness of traditionally premium performing hardwood pulps, eg., eucalyptus pulp.

Xylan and glucan content and xylan to mannan ratios can be determined by standard techniques such as completely hydrolyzing the fiber in question and determining the amount of xylose and mannose present in the hydrolysis product.

The following examples are presented by way of illustration and not be way of limitation.

EXAMPLE 1

Aspen logs were debarked and chipped with conventional mill equipment. While each linear dimension of the chips ranged from a minimum of about 0.6 cm to a maximum of about 3.2 cm, 90% of the chips fell within the range of about 0.9 cm to about 2.2 cm. The moisture content of the chips at the time of their use was about 23%. About 414 kilograms (kg, bone dry basis) of chips was provided and introduced into a stainless steel digester. Oxygen was removed from the digester by steaming the chips with low pressure steam until the temperature of the entire bed was about 100° C. In a separate vessel, cooking liquor was provided by mixing about 17.8 kg ammonia and 303 kg sulfur dioxide with about 2,627 kg water. About 2,768 kg of this cooking liquor, at 110° C., was introduced into the digester. This quantity of cooking liquor was sufficient to completely submerge all the chips contained within the digester. The lignin within the chips was sulfonated by maintaining the digester at about 110° C. and about 7 atmospheres pressure for about 30 minutes. A side relief operation was then instituted by removing about 1,062 kg cooking liquor from the digester. About 50% of the chip bed remained submerged in cooking liquor and the weight ratio of ammonia to wood was about 0.025. The cooking liquor remaining in the digester was heated externally by withdrawing a stream from near the center of the digester, heating the stream, and dividing it into two portions. One portion was introduced into the top of the digester, the other into the bottom. The temperature within the digester was increased in this manner to about 147° C. at a rate of about 0.9° C. per minute. The temperature within the digester was maintained at about 147° C. and the pressure at about 7 atmospheres for about 40 minutes. The pH within the digester was about 2.5. Following the hydrolysis at 147° C., the pressure within the digester was rapidly reduced to about 4.5 atmospheres in about 20 minutes and the contents of the digester were then blown from the digester into a tank maintained at atmospheric pressure.

The resulting pulp washed and screened by conventional methods. The xylan content was 7.7% and the xylan to mannan ratio was 2.75. After determining xylan and mannan contents, the pulp was bleached with sodium hypochlorite. It was used to make tissue paper according to the process of the hereinbefore incorporated patent to Morgan and Rich. This tissue paper comprised three layers of essentially equal weight, the center layer being formed of northern softwood kraft pulp while the two outer layers were formed from the soft wood pulp made in this example. When evaluated by a sensory evaluation panel, the tissue was found to be only slightly less soft than a similar tissue made so that the two outer layers comprised about 40% eucalyptus pulp and about 60% conventional sulfite pulp.

EXAMPLE 2

Example 1 was repeated except that 390 kg (bone dry basis) of chips having a moisture content of about 17% was provided to the digester. The cooking liquor comprised about 0.55% ammonia and about 8.2% sulfur dioxide. About 1,751 kg of the cooking liquor was introduced into the digester; this amount of liquor was sufficient to cover only about 50% of the chips within the digester. Side relief operation was not used. The ammonia-to-wood weight ratio was about 0.025. Hydrolysis time at about 147° C. was about 50 minutes.

When the pulp made in this example was evaluated as was the pulp from Example 1, it was found that the xylan content was 6.5 and the xylan to mannan ratio was 2.95. The softness of tissues made from the pulp of this Example 2 was somewhat less than that of the pulp made in Example 1. However, the pulp produced in this example was softer than conventional hardwood pulp. It is believed that the relative decrease in softness, compared to the pulp in Example 1 was a result of having only 50% of the chips fully submerged in the digester during the 110° C. cook. The side relief operation performed in Example 1 wherein superior softness was obtained reduced the liquor to the same level originally utilized in Example 2. However, 100% chip coverage during the pre-hydrolysis cooking stages was practiced in Example 1.

EXAMPLE 3

Example 1 was repeated except that about 430 kg of chips having a moisture content of about 17% was provided to the digester. The chips in the digester were completely submerged with about 2,818 kg of cooking liquor comprising about 0.4% ammonia and 9.4% sulfur dioxide. No side relief was used. Hydrolysis time at about 147° C. was about 30 minutes. The weight ratio of ammonia to wood was about 0.025.

When evaluated as was the pulp made in Example 1, the pulp of this Example 3 was found to have a xylan content of 7.3, a xylan to mannan ratio of 3.65 and only slightly less softness than eucalyptus pulp.

EXAMPLE 4

Example 1 was repeated except that about 443 kg (bone dry basis) chips with a moisture of about 41.6% was introduced into the digester. The chips were completely submerged with about 2,688 kg cooking liquor comprising about 0.8% ammonia and about 10.9% sulfur dioxide. During side relief, about 1,017 kg of cooking liquor was removed. After side relief, the ammonia to wood ratio was about 0.033.

When evaluated as was the pulp of Example 1, the pulp of this Example 4 was found to have xylan content of 7.2, a xylan to mannan ratio of 2.88 and softness only slightly less than that of eucalyptus pulp.

What is claimed is:

1. Pulp produced by the process comprising the steps of:

a. providing hardwood chips having dimensions of from about 0.6 to about 2.5 centimeter;

b. introducing said chips into a digester;

c. removing substantially all the free oxygen from said chips;

d. providing a cooking liquor comprising from about 0.4% to about 3% by weight ammonia and from about 9% to about 14% by weight sulfur dioxide;

e. reacting the lignin in said chips by maintaining the temperature within said digester at less than about 110° C. to form lignin products, wherein said chips are reacted under substantially oxygen-free conditions and substantially all of said chips are immersed in said cooking liquor;

f. increasing the temperature within said digester to from about 140° C. to about 155° C. at a rate of from about 0.75° C. per minute to about 3° C. per minute under substantially oxygen-free conditions;

g. hydrolyzing said lignin reaction products at a temperature of from about 140° C. to 155° C. at a pH of from about 2 to about 3; and h. decreasing rapidly the temperature within said digester;

wherein said pulp subsequent to Step h comprises hardwood cellulosic fibers and has a xylan content of between about 6% and about 8% by weight on a dry pulp basis, a xylan to mannan weight ratio of between about 2.5 and about 3.7 and a glucan content of between about 80% and about 92% by weight on a dry pulp weight basis.

2. The pulp described in claim 1, wherein said hydrolyzing continues for from about 30 minutes to about 80 minutes.

3. The pulp described in claim 2, wherein said hydrolyzing is accompanied by a side relief operation and said decreasing of temperature is accomplished by reducing the pressure on said chips to essentially atmospheric pressure in less than about 50 minutes.

4. A tissue paper web made from the pulp of claim 3.

5. A tissue paper web made from the pulp of claim 2.

6. The pulp described in claim 1, wherein said decreasing of temperature is accomplished by reducing the pressure on said chips to essentially atmospheric pressure in less than about 50 minutes.

7. A tissue paper web made from the pulp of claim 6.

8. A tissue paper web made from the pulp of claim 1.

9. The pulp described in claim 1, wherein said xylan content is between about 6.5% and about 7.5%.

10. A tissue paper web made from the pulp of claim 9.

11. The pulp described in claim 9, wherein said xylan content is between about 7.0% and 7.5%.

12. A tissue paper web made from the pulp of claim 11.

13. Pulp from hardwood fiber sources having a high tactile sense of softness, said pulp comprising hardwood cellulosic fibers having between about 6% and about 8% xylan by weight on a dry pulp basis, between about 80% and about 92% glucan by weight on a dry pulp basis, and an amount of mannan such that a weight ratio of xylan to mannan is between about 2.5 and about 3.7.

14. Pulp as described in claim 13, wherein said pulp comprises between about 6.5% and about 7.5% xylan.

15. Pulp as described in claim 14, wherein said pulp comprises between about 7.0% and about 7.5% xylan.

16. A tissue paper web made from the pulp of claim 15.

17. A tissue paper web made from the pulp of claim 14.

18. A tissue paper web made from the pulp of claim 13.

* * * * *